US010953526B2

(12) United States Patent
Mielich

(10) Patent No.: US 10,953,526 B2
(45) Date of Patent: Mar. 23, 2021

(54) METHOD AND DRIVE-OUT DEVICE FOR DRIVING OUT A BLADE

(71) Applicant: Siemens Aktiengesellschaft, Munich (DE)

(72) Inventor: Kai Mielich, Hilden (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 34 days.

(21) Appl. No.: 15/746,971

(22) PCT Filed: Jun. 30, 2016

(86) PCT No.: PCT/EP2016/065289
§ 371 (c)(1),
(2) Date: Jan. 23, 2018

(87) PCT Pub. No.: WO2017/021074
PCT Pub. Date: Feb. 9, 2017

(65) Prior Publication Data

US 2019/0009396 A1 Jan. 10, 2019

(30) Foreign Application Priority Data

Aug. 6, 2015 (DE) ..... 102015215004.6

(51) Int. Cl.
*B25B 27/02* (2006.01)
*F01D 5/30* (2006.01)

(52) U.S. Cl.
CPC ..... *B25B 27/026* (2013.01); *F01D 5/3007* (2013.01); *F05D 2230/60* (2013.01); *F05D 2230/70* (2013.01)

(58) Field of Classification Search
CPC ..... B25B 27/026; B23P 19/00; F05D 2230/70
See application file for complete search history.

(56) References Cited

U.S. PATENT DOCUMENTS 2,200,998 A * 5/1940 Schnuck ..... B30B 15/16 100/218
4,455,730 A * 6/1984 Guenther ..... B23P 15/02 29/252

(Continued)

FOREIGN PATENT DOCUMENTS

DE 102008024018 A1 11/2008
EP 1149662 A1 10/2001

(Continued)

OTHER PUBLICATIONS

PCT International Search Report for corresponding to PCT International Application No. PCT/EP2016/065289 dated Oct. 17, 2016.

(Continued)

*Primary Examiner* — Jacob J Cigna
*Assistant Examiner* — Michael W Hotchkiss
(74) *Attorney, Agent, or Firm* — Schmeiser, Olsen & Watts LLP

(57) ABSTRACT

A method is provided having the following steps: a) providing a drive-out device which has a drive-out punch that is actuated via a hydraulic cylinder; b) positioning the drive-out device between two adjacent wheel discs of the rotor such that a longitudinal axis of the drive-out punch is flush with the receiving groove of the blade to be driven out; c) adjusting a maximum pressure which can be applied to the hydraulic cylinder; d) extending the drive-out punch such that the drive-out punch presses against the blade root of the blade to be driven out with increasing pressure; e) reducing the pressure as soon as the pressure has reached the maximum pressure; and f) cyclically repeating the steps d) and e) until the blade has been removed from the receiving groove. A drive-out device is further provided.

14 Claims, 3 Drawing Sheets

(56) References Cited

U.S. PATENT DOCUMENTS 4,721,028 A * 1/1988 Lucas ..... B30B 15/16 91/433
5,587,536 A * 12/1996 Rasmussen ..... F15B 15/28 73/744
5,668,328 A * 9/1997 Steber ..... B25B 21/005 73/862.23
5,737,992 A * 4/1998 Torrekens ..... B25B 23/145 91/361
6,571,471 B2 * 6/2003 Hohmann ..... B23P 6/002 29/426.5
7,200,992 B2 * 4/2007 Wagner ..... B25B 21/005 60/379
7,455,505 B2 * 11/2008 Hartmann ..... B23P 6/002 29/889.1
7,739,941 B2 * 6/2010 Noble ..... F15B 11/15 91/363 R
8,056,473 B2 * 11/2011 Frenken ..... B30B 15/16 100/35
8,161,741 B2 * 4/2012 Ingersoll ..... F02C 6/16 417/396
8,863,365 B2 * 10/2014 Silieti ..... B23P 19/033 29/254
9,381,602 B2 * 7/2016 Holmes ..... B23P 19/027
9,494,040 B2 * 11/2016 Bird ..... F01D 5/005
9,989,048 B2 * 6/2018 Bean ..... F04B 49/002
10,010,066 B2 * 7/2018 Krondorfer ..... A01M 1/02
2001/0032389 A1 * 10/2001 Hohmann ..... B23P 6/002 29/889.1
2001/0037689 A1 * 11/2001 Krouth ..... F15B 15/2838 73/861.52
2003/0079603 A1 * 5/2003 Schumacher ..... F15B 15/2838 91/361
2006/0207309 A1 * 9/2006 Miosga ..... F01D 5/30 72/453.15
2009/0133591 A1 * 5/2009 Frenken ..... B25B 27/10 100/269.01
2009/0260485 A1 * 10/2009 Hohmann ..... B25B 21/005 81/2
2010/0162546 A1 * 7/2010 Kalmar ..... F01D 5/005 29/244
2010/0300308 A1 * 12/2010 Frenken ..... B30B 15/166 100/35
2015/0128417 A1 * 5/2015 Laborde ..... F01D 25/285 29/889.1
2015/0218948 A1 * 8/2015 Bird ..... F01D 5/005 29/889.1

FOREIGN PATENT DOCUMENTS

EP 2110205 A2 10/2009
EP 2211027 A1 7/2010
KR 20110025260 A 3/2011
WO WO 2012167824 A1 12/2012

OTHER PUBLICATIONS

Korean Office Action for application No. 10-2018-7005912 dated May 21, 2019.

* cited by examiner

METHOD AND DRIVE-OUT DEVICE FOR DRIVING OUT A BLADE

CROSS-REFERENCE TO RELATED APPLICATIONS

This application claims priority to PCT Application No. PCT/EP2016/065289, having a filing date of Jun. 30, 2016, based off of German application No. De 102015215004.6 having a filing date of Aug. 6, 2015, the entire contents of both of which are hereby incorporated by reference.

FIELD OF TECHNOLOGY

The following relates to a method for driving out a blade, the blade root of which is held in an elongate receiving groove of a wheel disk. Embodiments of the present invention also relate to a drive-out device which is designed for carrying out such a method.

BACKGROUND

Gas and steam turbines comprise rotors which in the area of the compressor and the turbine are made up of multiple wheel disks, to which a multiplicity of blades are fastened. The roots of the blades, usually formed like a dovetail, are in this case respectively held in a form-fitting manner in grooves that are correspondingly shaped and formed in the wheel disks. The securing of the blades against axial displacement in the corresponding receiving grooves is normally realized either by way of securing plates or by two securing lugs being stamped on at the ends of the respective receiving groove.

During operation, the blades are subjected to high loads, and consequently are exposed to wear, for which reason they have to be exchanged or repaired after certain operating times as part of an overhaul. For this purpose, in a first step the rotor is disassembled from the housing of the turbo machine. Then, the rotor is destacked, in order to separate the individual wheel disks with the blades held on them from one another. After that, the blades of the respective wheel disks are driven out. According to a known variant, for this purpose a wheel disk is first placed with the hub horizontally on an underlying surface. Then, two workers at a time use a copper bolt and corresponding hammer blows to drive the blades out one after the other. One worker in this case grips the copper bolt, usually wrapped in cleaning rags, and places it on the blade root. The second worker uses a sledgehammer weighing 5 or 10 kg to strike the copper bolt. Depending on the size of the blade root, the blade height, any oversize in the fit and the operating time of the turbo machine, between 20 and 25 blows are necessary for driving out a blade. The physical exertion on the part of the workers and the risk of injury are great. It is also possible for the wheel disk and the blade to be easily damaged when driving out blades manually. In particular, scoring may occur at the blade root and at the contact areas of the receiving groove. The scores occur when cold-welded regions of the wheel disk and the blade root are displaced with respect to one another under the effect of excessive force. Depending on the severity of the scoring found, a necessary exchange of the wheel disk cannot be ruled out, which involves high costs. A further disadvantage is that the rotor on the wheel disks of which the blades are held must be disassembled and destacked before the driving out of the blades, which involves very great expenditure of time. In addition, the disassembly and the destacking of a rotor usually require special equipment, which is often not available on site and therefore has to be delivered.

In the case of an alternative known variant, the driving out of the blades may also be performed by using a drive-out device. Thus, for example, WO 2012/167824 A1 discloses a drive-out device which has a frame, a rotary table, a striking unit held on the frame with a driving-out ram and a striking mechanism acting on the driving-out ram. However, even when such a drive-out device is used there is the risk of the previously described scoring. Similarly, as in the case of manual driving out, disassembly and destacking of the rotor are required.

SUMMARY

An aspect relates to providing an alternative method and an alternative drive-out device of the type mentioned at the beginning.

To achieve this object, embodiments of the present invention provide a method for driving out a blade, the blade root of which is held in an elongate receiving groove of a wheel disk arranged on a stacked rotor, the method comprising the steps of: a) providing a drive-out device, which has a driving-out ram actuated by way of a hydraulic cylinder; b) positioning the drive-out device between two adjacent wheel disks of the rotor in such a way that a longitudinal axis of the driving-out ram is in line with the receiving groove of the blade to be driven out; c) setting a maximum pressure to which the hydraulic cylinder can be subjected; d) extending the driving-out ram, so that the driving-out ram presses with increasing pressure against the blade root of the blade to be driven out; e) reducing the pressure as soon as it has reached the maximum pressure; and f) cyclically repeating steps d) and e) until the blade has been removed from the receiving groove.

A major advantage of the method according to embodiments of the invention is that the hydraulic pressure required for driving out a blade when carrying out steps d) and e) is provided in a cycling or pulsating manner. This has the advantage that the force to be applied for driving out a blade from the wheel disk is not applied at a uniformly increasing rate until the connection breaks away, but instead the breakaway force is reduced by applying a pulsating force to the blade root, the driving out of the blade being additionally promoted by this inducement of vibration. This is accompanied by the major advantage that cold-welded regions of the wheel disk and the blade root are detached much better, without scoring occurring.

According to a refinement of embodiments of the present invention, the receiving groove is inclined with respect to an axial direction of the rotor. On account of the fact that in step b) the longitudinal axis of the driving-out ram is positioned in line with the receiving groove, even with such an inclination the contact areas of the receiving groove are not subjected to loading during the driving out of the blade.

The maximum pressure is preferably at least 150 bar, better still at least 200 bar or at least 300 bar.

According to a variant of the method according to embodiments of the invention, in step e) the pressure is reduced until it has reached a preset minimum pressure, whereupon the pressure is increased once again in the subsequent step d). The maximum pressure in this case preferably lies at least 80 bar above the minimum pressure, better still at least 100 bar.

According to a further variant of the method according to embodiments of the invention, in step e) the pressure is reduced for a predetermined time period, after which the pressure is increased again in the subsequent step d).

Steps d) and e) are advantageously repeated with a cycle time in the range of 2 Hz to 10 Hz. Thanks to such a cycle time, blades can be driven out within a very short time period. The method is preferably carried out in a state in which the stacked rotor is accommodated in a housing of a turbo machine, whereby the effort and time for driving out blades are significantly reduced.

To achieve the object mentioned at the beginning, embodiments of the present invention also provides a drive-out device, in particular for carrying out a method according to embodiments of the invention, with an electrohydraulic pump, which is connected to an oil tank, a hydraulic cylinder, which is connected to the pump by way of a switchable valve, a driving-out ram, which is operatively connected to a piston rod of the hydraulic cylinder in such a way that it is moved by the piston rod in the direction of its longitudinal axis as soon as the hydraulic cylinder is subjected to a pressure by the pump, and a pump controller, which is designed in such a way that it switches the valve to reduce the pressure as soon as the pressure has reached a preset maximum pressure, and in such a way that it switches the valve to increase the pressure as soon as the pressure has reached a preset minimum pressure, or as soon as a predetermined time period has elapsed.

The hydraulic cylinder is preferably fastened to a housing into which the piston rod protrudes and from which the driving-out ram projects, can be extended and retracted again.

The longitudinal axis of the driving-out ram (15) and a housing wall from which the driving-out ram (15) projects advantageously define an angle that is different from 90°. In other words, the driving-out ram projects obliquely from the housing, to be precise in a way corresponding to the angle of the blade groove in relation to the rotor axis in which the blade to be driven out is held.

Advantageously arranged in the housing is a mechanism which transforms the straight movement of the piston rod into a straight movement of the driving-out ram, the directions of movement of the piston rod and of the driving-out ram being different. This is of advantage to the extent that the drive-out device can be made very narrow in the direction of movement of the driving-out ram, so that the drive-out device according to embodiments of the invention can be positioned between two wheel disks of a stacked rotor.

The mechanism preferably comprises a first body, which is fastened to the piston rod and defines a first sloping surface, a second body, which is fastened fixedly within the housing and defines a second sloping surface, and a third body, which is fixedly connected to the driving-out ram or defines it and defines a third and a fourth sloping surface, the third sloping surface lying against the first sloping surface and the fourth sloping surface lying against the second sloping surface and being guided. In this way, a very simple construction is achieved.

BRIEF DESCRIPTION

Some of the embodiments will be described in detail, with reference to the following figures, wherein like designations denote like members, wherein.

Figure 1:
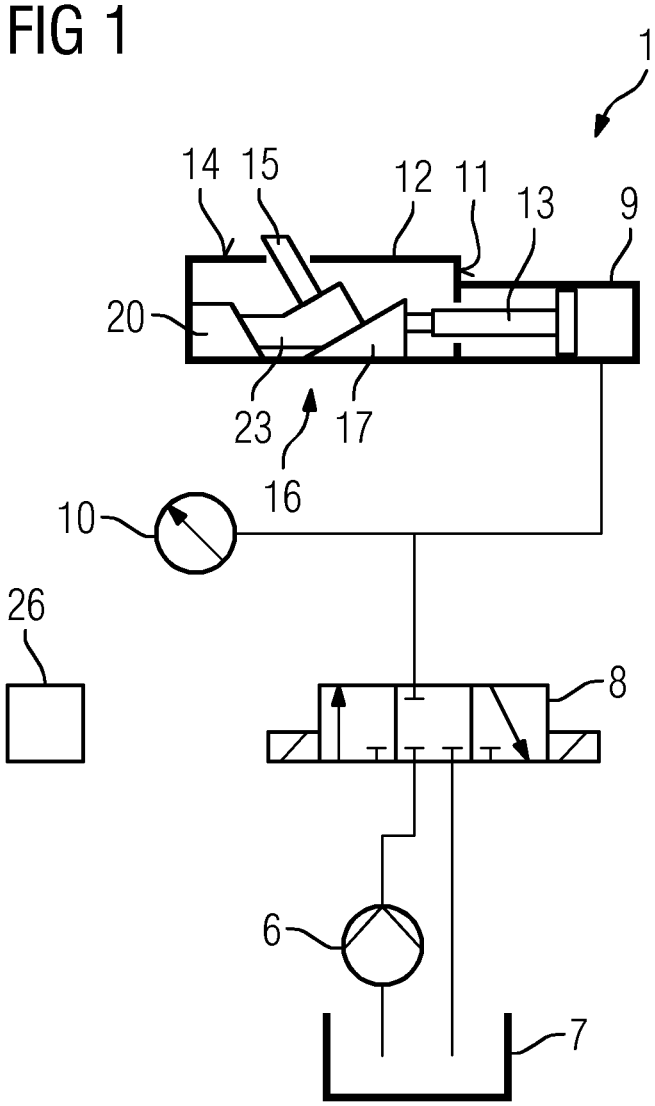
FIG. 1 shows a schematic view of a drive-out device, in accordance with embodiments of the present invention.
Figure 2:
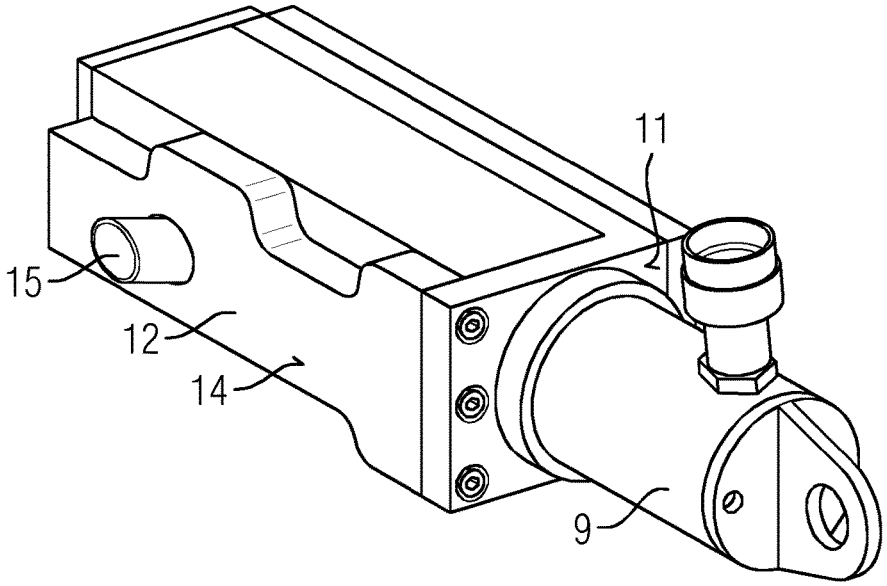
FIG. 2 shows a perspective view of a housing shown in FIG. 1, on which a hydraulic cylinder is arranged and from which a driving-out ram projects, in accordance with embodiments of the present invention.
Figure 3:
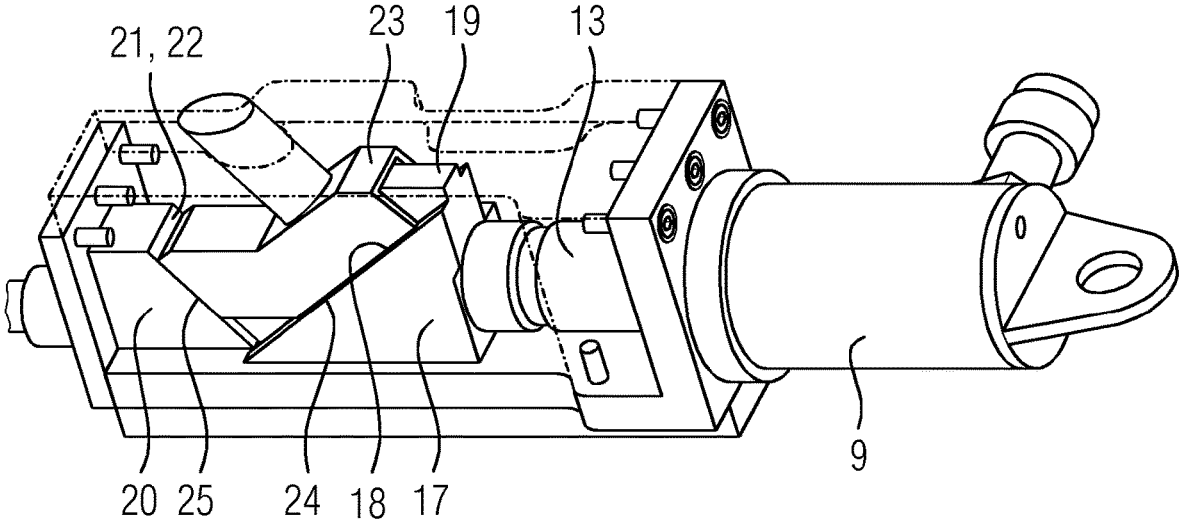
FIG. 3 shows a further perspective view of the housing shown in FIG. 2, a housing covering of the housing not being shown for the sake of providing a better representation, in accordance with embodiments of the present invention.
Figure 4:
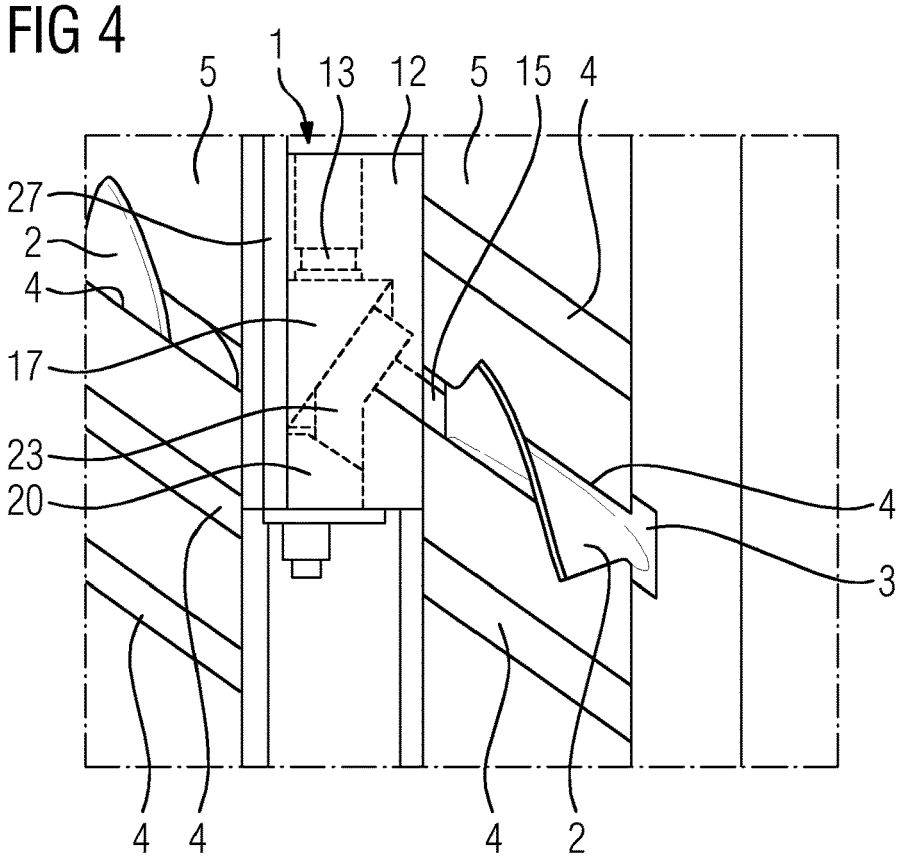
Figure 5:
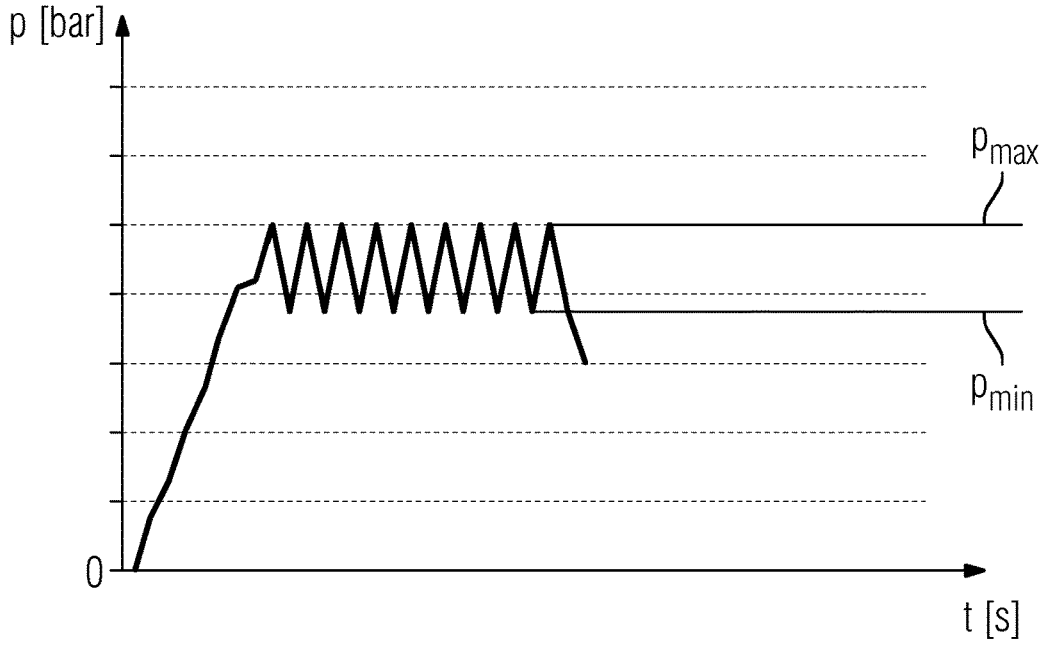

FIG. 4 shows a perspective view of the housing represented in FIGS. 2 and 3, in a state in which it has been fastened for driving out a blade on a wheel disk, in accordance with embodiments of the present invention; and FIG. 5 shows a diagram which shows the schematic profile of a pressure to which the hydraulic cylinder of a hydraulic pump represented in FIG. 1 for driving out the blade shown in FIG. 4 is subjected, in accordance with embodiments of the present invention.

DETAILED DESCRIPTION

FIG. 1 shows a drive-out device 1 according to an embodiment of the present invention that serves for driving out a blade 2, the blade root 3 of which is held in an elongate receiving groove 4 of a wheel disk 5, as will be explained in still more detail below with reference to FIGS. 4 and 5. The drive-out device 1 comprises an electrohydraulic pump 6, which is connected to an oil tank 7, which in the present case has a tank volume of 20 $dm^3$. The pump 6 has a maximum operating pressure of 700 bar with an adjustable pressure limiting valve, a delivery volume of 0.55 l/min, a motor output of 0.75 kW and a motor voltage of 230 V, it also being possible in principle for other suitable pumps with similar characteristic values to be used. The pump 6 is connected to a hydraulic cylinder 9 by way of a switchable valve 8, in the present case a 3/3-way electromagnetic valve, which realizes the functions of extending, holding and retracting. Arranged between the valve 8 and the hydraulic cylinder 9 is a pressure measuring device 10, which senses the pressure present at the hydraulic cylinder 9. The hydraulic cylinder 9 is fastened to the end face 11 of an elongate, substantially rectangularly formed housing 12 in such a way that its piston rod 13 protrudes into the interior of the housing 12. Connected to the piston rod 13 by way of a mechanism 16 arranged within the housing 12 is a driving-out ram 15 protruding obliquely out of a side face 14 of the housing 12. The mechanism 16 comprises a first body 17, which is fastened to the piston rod 13 and defines a first sloping surface 18, on which a first guide 19 is formed. Furthermore, the mechanism 16 comprises a second body 20, which is fastened fixedly within the housing 12 and defines a second sloping surface 21, which extends perpendicularly in relation to the first sloping surface 18 of the first body 17 and is provided with a second guide 22. In addition, the mechanism 16 comprises a third body 23, which is fixedly connected to the driving-out ram 15 or is formed integrally with it. The third body 23 has a third sloping surface 24 and a fourth sloping surface 25, the third sloping surface 24 lying against the first sloping surface 18 and the fourth sloping surface 25 lying against the second sloping surface 21 and being guided along the respective guide 19, 22. Furthermore, the drive-out device 1 comprises a pump controller 26.

For driving out a blade 2 from the associated receiving groove 4, the drive-out device 1 or its housing 12 is first positioned between two wheel disks 5 of a stacked rotor arranged in a turbo machine, in such a way that the longitudinal axis of the driving-out ram 15 is in line with the receiving groove 4. In the present case, a compensating plate 27 is additionally placed between the housing 12 of the drive-out device 1 and that wheel disk 5 from which no blade 2 is to be driven out, in order to fill a gap remaining between the housing 12 and the wheel disk 5. In a further step, a minimum pressure $p_{min}$ and a maximum pressure $p_{max}$ are set on the pump controller 26. In the present case, the minimum pressure $p_{min}$ is 380 bar and the maximum pressure $p_{max}$ is 500 bar, it also being possible in principle for other pressure values to be set. In a further step, the driving-out ram 15 is extended and presses with increasing pressure against the blade root 3, in that the pump 6 and the hydraulic cylinder 9 are connected to one another by corresponding actuation of the valve 8. The pressure is increased further until the pressure measuring device 10 senses the maximum pressure $p_{max}$. If in this state the blade has not yet been driven out, the pressure is reduced again, in that the pump controller 26 switches the valve 8 correspondingly until the pressure reaches the preset minimum pressure $p_{min}$, which in turn is detected by the pressure measuring device 10. Subsequently, the pressure is increased once again to the maximum pressure $p_{max}$, as schematically represented in FIG. 5. This cycle is repeated with a cycle time in the range from 2 Hz to 10 Hz until the blade root 3 has been driven out from the receiving groove 4 of the wheel disk 5 completely. Subsequently, the valve 8 is moved into its middle position.

On account of the fact that the hydraulic pressure required for driving out a blade 2 is provided in a pulsating manner, and that the force exerted by the driving-out ram 15 on the blade root 3 acts in the direction of extent of the receiving groove 4 means that only a small force is required for the breaking away of the connection between the blade 2 and the wheel disk 5. This is accompanied by the significant advantage that cold-welded regions of the wheel disk and the blade root are detached well, without scoring occurring. A further advantage is that, on account of the small size of the housing 12, the method can be carried out on the stacked rotor and with the rotor mounted in the turbo machine, that is to say in situ, which is accompanied by a great saving of time and cost.

It should be pointed out that, according to a variant of the driving-out method according to embodiments of the invention, the pressure can also be reduced by the valve 8 after reaching the maximum pressure $p_{max}$ and then increased again after the elapse of a predetermined time period $\Delta t$, that is to say time-dependently and not in dependence on a minimum pressure $p_{min}$.

Although the invention has been more specifically illustrated and described in detail by the preferred exemplary embodiment, the invention is not restricted by the disclosed examples and other variations can be derived herefrom by a person skilled in the art without departing from the scope of protection of the invention.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A method for driving out a blade, a blade root of which is held in an elongate receiving groove of a wheel disk arranged on a stacked rotor, the method comprising:

a) providing a drive-out device, which has a driving-out ram actuated by way of a hydraulic cylinder, the drive-out device having a housing and a mechanism within the housing which transforms a straight movement of the piston rod into a straight movement of the driving-out ram, the directions of movement being different, wherein the mechanism includes a first body, which is fastened to the piston rod and defines a first sloping surface, a second body, which is fastened fixedly within the housing and defines a second sloping surface, and a third body, which is fixedly connected to the driving-out ram and slidably engages the first sloping surface;

b) positioning the drive-out device between two adjacent wheel disks of the stacked rotor in such a way that a longitudinal axis of the driving-out ram is in line with the elongate receiving groove of the blade to be driven out;

c) setting a maximum pressure to which the hydraulic cylinder can be subjected;

d) extending the driving-out ram, so that the driving-out ram presses with increasing pressure against the blade root of the blade to be driven out, wherein the pressure is increased until the maximum pressure is reached;

e) reducing the pressure to a preset minimum pressure as soon as the pressure has reached the maximum pressure and increasing the pressure to the maximum pressure as soon as the minimum pressure is reached so that a hydraulic pressure is provided to the drive-out device in a pulsating manner; and f) cyclically repeating steps d) and e) until the blade has been removed from the elongate receiving groove.

2. The method as claimed in claim 1, wherein the elongate receiving groove is inclined with respect to an axial direction of the stacked rotor.

3. The method as claimed in claim 1, wherein the maximum pressure is at least 150 bar.

4. The method as claimed in claim 1, wherein steps d) and e) are repeated with a cycle time in the range of 2 Hz to 10 Hz.

5. The method as claimed in claim 1, wherein the maximum pressure is at least 80 bar above the minimum pressure .

6. The method as claimed in claim 1, wherein the method is carried out in a state in which the stacked rotor is accommodated in a housing of a turbo machine.

7. The method as claimed in claim 1, wherein the third body, defines a third and a fourth sloping surface, the third sloping surface lying against the first sloping surface and the fourth sloping surface lying against the second sloping surface and being guided.

8. The method as claimed in claim 1, wherein the maximum pressure is at least 200 bar.

9. The method as claimed in claim 1, wherein the maximum pressure is at least 300 bar.

10. The method as claimed in claim 1, wherein the maximum pressure is at least 100 bar above the minimum pressure.

11. The method as claimed in claim 1, wherein the hydraulic pressure is pulsated between a range of pressure defined by the maximum and the minimum pressure.

12. A drive-out device for carrying out a method as claimed in claim 1, with an electrohydraulic pump, which is connected to an oil tank, a hydraulic cylinder, which is connected to the electrohydraulic pump by way of a switchable valve, a driving-out ram, which is operatively connected to a piston rod of the hydraulic cylinder in such a way that hydraulic cylinder is moved by the piston rod in a direction of a longitudinal axis as soon as the hydraulic cylinder is subjected to a pressure by the electrohydraulic pump, and a pump controller, which is designed in such a way that the pump controller switches the switchable valve to reduce the pressure as soon as the pressure has reached a preset maximum pressure, and in such a way that pump controller switches the switchable valve to increase the pressure as soon as the pressure has reached a preset minimum pressure ($p_{min}$), or as soon as a predetermined time period has elapsed.

13. The drive-out device as claimed in claim 12, wherein the hydraulic cylinder is fastened to a housing into which the piston rod protrudes and from which the driving-out ram projects.

14. The drive-out device as claimed in claim 13, wherein a longitudinal axis of the driving-out ram and a housing wall from which the driving-out ram projects define an angle that is different from 90° .

* * * * *